US008881555B2

(12) United States Patent
Kim et al.

(10) Patent No.: US 8,881,555 B2
(45) Date of Patent: Nov. 11, 2014

(54) DRAIN DEVICE AND WASHING MACHINE HAVING THE SAME

(75) Inventors: Young Hyun Kim, Suwon-si (KR); Seoung Jin Seo, Suwon-si (KR); Jae Hyun Jang, Suwon-si (KR); Hong Seok Ko, Yongin-si (KR); Dong Bin Lim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1455 days.

(21) Appl. No.: 12/078,940

(22) Filed: Apr. 8, 2008

(65) Prior Publication Data

US 2008/0276657 A1 Nov. 13, 2008

(30) Foreign Application Priority Data

May 8, 2007 (KR) ..... 10-2007-0044409
Nov. 5, 2007 (KR) ..... 10-2007-0111927

(51) Int. Cl.

| | |
|---|---|
| ***D06F 29/00*** | (2006.01) |
| ***D06F 39/10*** | (2006.01) |
| ***D06F 39/08*** | (2006.01) |
| ***A47L 15/42*** | (2006.01) |

(52) U.S. Cl.
CPC ..... *D06F 39/083* (2013.01); *D06F 39/10* (2013.01); *A47L 15/4206* (2013.01)
USPC ..... 68/18 F

(58) Field of Classification Search
CPC .... A47L 15/4206; D06F 39/10; D06F 39/083
USPC ..... 68/18 F, 208
See application file for complete search history.

(56) References Cited

U.S. PATENT DOCUMENTS 1,775,922 A * 9/1930 Abbott, Jr. ..... 68/189
2004/0104158 A1* 6/2004 Kim et al. ..... 210/295

FOREIGN PATENT DOCUMENTS

| | | | |
|---|---|---|---|
| DE | 1929516 | * | 12/1965 |
| EP | 1162300 | | 12/2001 |
| GB | 1526857 A | * | 10/1978 |
| KR | 10-2003-0060547 | | 7/2003 |
| KR | 10-2003-0089913 | | 11/2003 |
| KR | 10-2004-0046982 | | 6/2004 |

OTHER PUBLICATIONS

Machine Translation of DE 1929516, Dec. 23, 1965.*

* cited by examiner

*Primary Examiner* — David Cormier
(74) *Attorney, Agent, or Firm* — Staas & Halsey LLP

(57) ABSTRACT

Disclosed are a drain device having a drain filter, which causes foreign substances contained in washing water to be effectively filtered out by a filter chamber to prevent the foreign substances from flowing into a pump chamber, and allows the washing water to smoothly flow in the filter chamber to use the drain filter for a long time, and a washing machine having the same. The washing machine includes a housing provided with a washing chamber; and a drain device including a filter chamber provided with a filter member installed therein filtering out foreign substances from washing water in the washing chamber, and a pump chamber connected to the filter chamber to forcibly discharge the washing water. The filter member has a sectional area gradually increased toward the pump chamber and is provided with an end terminal separated from an inlet of the pump chamber by a designated distance.

19 Claims, 8 Drawing Sheets

DRAIN DEVICE AND WASHING MACHINE HAVING THE SAME

CROSS-REFERENCE TO RELATED APPLICATIONS

This application claims the benefit of Korean Patent Application Nos. 2007-0044409, filed May, 8, 2007, and 2007-0111927, filed Nov. 5, 2007, in the Korean Intellectual Property Office, the disclosure of which is incorporated herein by reference.

BACKGROUND

1. Field

The present invention relates to a drain device and a washing machine having the same, and more particularly, to a drain device having a filter to filter out foreign substances from washing water during a draining operation and a washing machine having the same.

2. Description of the Related Art

Generally, washing machines are divided into pulsator washing machines, which wash laundry by rotating washing water and the laundry using a pulsator rotatably installed on the bottom of an inside of a tub, agitator washing machines, which wash laundry by agitating washing water and the laundry using an agitator protruded from a central region of the inside of the tub, and drum washing machines, which wash laundry by repeatedly lifting and dropping the laundry through the rotation of a drum accommodating the laundry. Recently, the drum-type washing machines, which have excellent washing power, use a small amount of water, and scarcely damage laundry, are increasingly in demand.

Each of the above various washing machines includes a drain device to discharge washing water from a washing chamber to the outside in a dehydrating operation. Generally, a drain device includes a drain case having a filter chamber to filter out foreign substances coming apart from laundry, such as hairs and nap, from washing water and a pump chamber to forcibly discharge the washing water, an internal drain hose guiding the washing water in the washing chamber to the drain case, an external drain hose guiding the washing water in the drain case to the outside of the washing machine, and a drain valve installed in the internal drain hose.

Korean Patent Application No. 10-2002-0027826 (Publication No. 10-2003-89913) discloses a drain device. The drain device disclosed in the above Application is installed such that a front part of a drain case is connected to a mounting hole formed in a front surface of a housing of a washing machine and a drain pump is exposed forwardly from the housing. Washing water flowing into the drain case is filtered via a filter portion, and is discharged to the outside by a high-speed rotation of an impeller via a pump chamber.

In the above conventional drain filter, a channel pipe having a hollow cylindrical shape is installed at a central portion of a filtering plate to filter out foreign substances. Therefore, large foreign substances, such as coins and buttons, can be effectively filtered by the filter portion, but smaller foreign substances, such as toothpicks and hairpins, cannot be completely filtered out by the filter portion and may flow into the pump chamber, thereby generating restriction and breakage of the impeller, and thus causing poor draining and malfunction of the pump.

Further, Korean Patent Registration No. 0441095 discloses a pump unit of a washing machine, in which a drain filter having a plurality of through-holes formed in a mesh shape is installed in a filter chamber. In the same manner as the earlier conventional drain filter, this drain filter of the pump unit can effectively filter out large foreign substances, but the foreign substances are accumulated around the through-holes at a high speed and thus the amount of drained washing water is reduced in a short time, thereby causing a user to frequently clean the drain filter.

Further, in each of the above conventional drain devices, since the washing water flows into the conventional drain device through a side surface of the drain case, in the case that foreign substances having a bar shape, such as candy sticks, toothpicks, and hairpins, flow into the filter chamber, the foreign substances are accumulated rapidly, and the drain filter cannot be easily attached to and detached from the pump unit.

SUMMARY

Therefore, one aspect of the embodiments is to provide a drain device having a drain filter, which causes foreign substances contained in washing water to be effectively filtered out by a filter chamber to prevent the foreign substances from flowing into a pump chamber, and allows the washing water to smoothly flow in the filter chamber so as to use the drain filter for a long time, and a washing machine having the same.

Additional aspects and/or advantages will be set forth in part in the description which follows and, in part, will be apparent from the description, or may be learned by practice of the invention.

The foregoing and/or other aspects are achieved by providing a drain device, including a drain case including a filter chamber provided with a filter member installed therein filtering out foreign substances from washing water, and a pump chamber connected to the filter chamber to forcibly discharge the washing water, wherein the filter member has a sectional area gradually increased toward the pump chamber and is provided with an end terminal separated from an inlet of the pump chamber by a designated distance.

The end terminal of the filter member may cover the inlet of the pump chamber.

A shortest distance of the area of the end terminal of the filter may be longer than a longest distance of the area of the inlet of the pump chamber.

A product of a separation distance from the end terminal of the filter member to the inlet of the pump chamber and an outer circumference of the end terminal of the filter member may be equal to or larger than the area of an outlet pipe of the drain case.

The filter member may be hollow, and include a main body and an extension portion having a sectional area larger than that of the main body; and the main body may be provided with at least one through hole.

The extension portion may have a flexible end terminal.

An inlet pipe, through which the washing water flows into the filter chamber, may be provided at a central portion of the filter chamber; and the through hole may be provided at one end of the drain case.

The filter member may further include a plurality of wing parts formed in a longitudinal direction of the filter member.

The wing parts may extend so as to be upwardly sloped in a direction of a decreased sectional area of the filter member, and sloped planes of the wing parts may have a concave streamline shape.

The foregoing and/or other aspects are achieved by providing a washing machine, including a housing provided with a washing chamber; and a drain device including a filter chamber provided with a filter member installed therein filtering out foreign substances from washing water in the washing chamber, and a pump chamber connected to the filter chamber to forcibly discharge the washing water, wherein the filter member has a sectional area gradually increased toward the pump chamber and is provided with an end terminal separated from an inlet of the pump chamber by a designated distance.

The drain device may further include an opening part formed therethrough such that the filter member is attached to and detached from the drain device through the opening part; and the filter member may be extended from a lid installed at the opening part.

The end terminal of the filter member may cover the inlet of the pump chamber.

A shortest distance of the area of the end terminal of the filter may be longer than a longest distance of the area of the inlet of the pump chamber.

A product of a separation distance from the end terminal of the filter member to the inlet of the pump chamber and an outer circumference of the end terminal of the filter member may be equal to or larger than the area of an outlet pipe of the drain device.

The filter member may be hollow, and include a main body and an extension portion having a sectional area larger than that of the main body; and the main body may be provided with at least one through hole.

The extension portion may have a flexible end terminal.

An inlet pipe, through which the washing water flows into the filter chamber, may be provided at a central portion of the filter chamber; and the through hole may be provided at the main body of the filter member.

The filter member may further include a plurality of wing parts formed in a longitudinal direction of the filter member; and the wing parts may extend so as to be upwardly sloped in a direction of a decreased sectional area of the filter member, and sloped planes of the wing parts may have a concave streamline shape.

The foregoing and/or other aspects are achieved by providing a washing machine, including a housing provided with a washing chamber; and a drain device including a filter chamber provided with a filter member installed therein filtering out foreign substances from washing water in the washing chamber, and a pump chamber connected to the filter chamber to forcibly discharge the washing water, wherein the filter member includes a core part having a sectional area increased toward the pump chamber, the core part being a hollow member with a through hole formed therethrough and being provided with an end terminal separated from an inlet of the pump chamber by a designated distance, and a plurality of wing parts formed in a longitudinal direction of the core part and extended so as to be upwardly sloped in a direction of a decreased sectional area of the core part.

An inlet pipe, through which the washing water flows into the filter chamber, may be provided at a central portion of the filter chamber; and the through hole may be provided at a start terminal of the core part.

The foregoing and/or other aspects are achieved by providing a washing machine, including: a washing chamber; a drain device communicating with the washing chamber, the drain device including an inlet pipe receiving washing water from the washing chamber, a drain case having a filter chamber in communication with the inlet pipe and a pump chamber having an inlet, a filter member having a body with a sectional width increasing from a first end to an end terminal, the end terminal being proximate to the inlet of the pump chamber, and an outlet pipe in communication with the pump chamber to receive water supplied through the filter chamber.

The filter member may be hollow.

The filter member may include a plurality of wing parts disposed along a longitudinal surface of the filter member, causing eddies of washing water to be formed.

BRIEF DESCRIPTION OF THE DRAWINGS

These and/or other aspects and advantages will become apparent and more readily appreciated from the following description of the embodiments, taken in conjunction with the accompanying drawings in which.

DETAILED DESCRIPTION OF THE EMBODIMENTS

Figure 1:
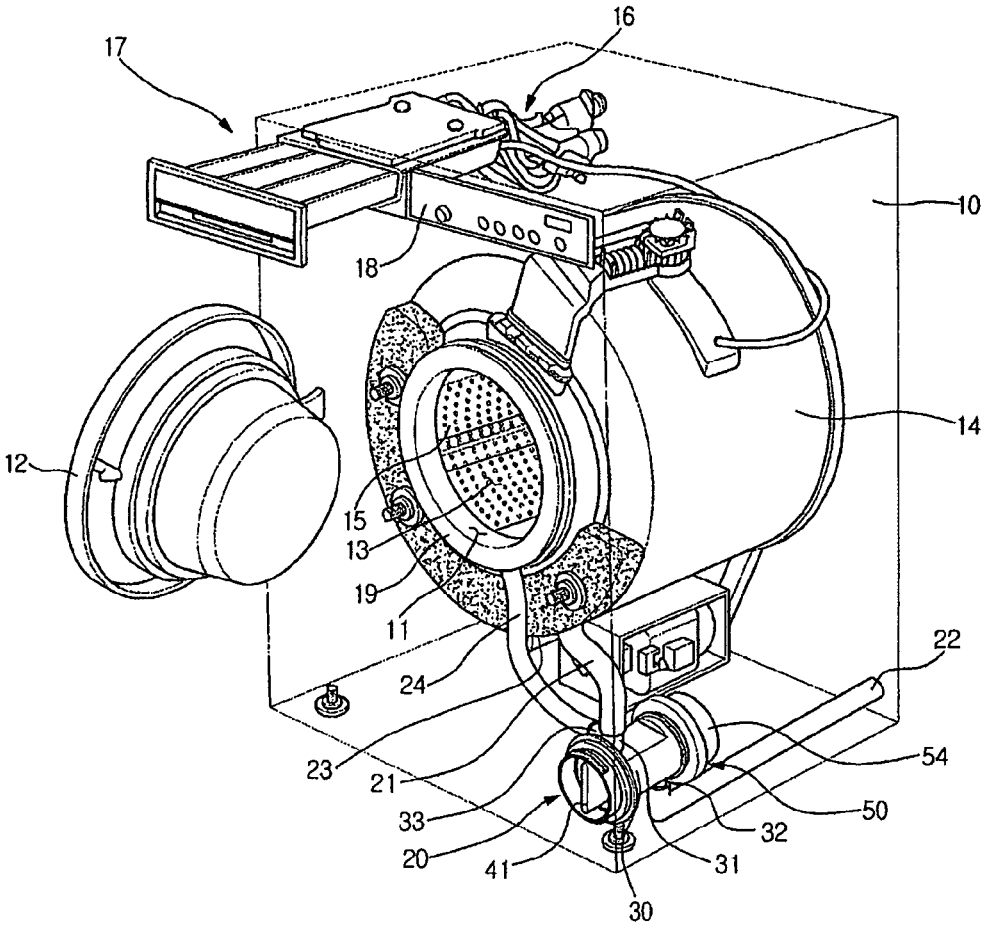
FIG. 1 is a schematic perspective view of a drum washing machine in accordance with a first embodiment.

Reference will now be made in detail to the embodiments, examples of which are illustrated in the accompanying drawings, wherein like reference numerals refer to like elements throughout. The embodiments are described below to explain the present invention by referring to the annexed drawings.

Figure 2:
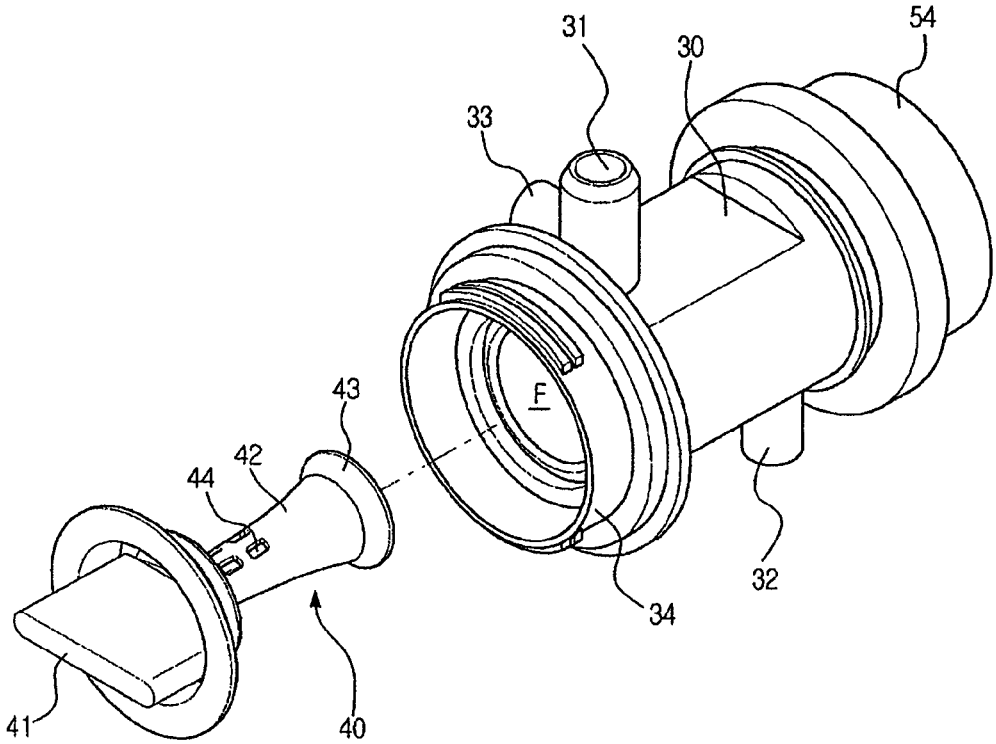
FIG. 2 is an exploded perspective view of a drain device in accordance with the first embodiment.
Figure 3:
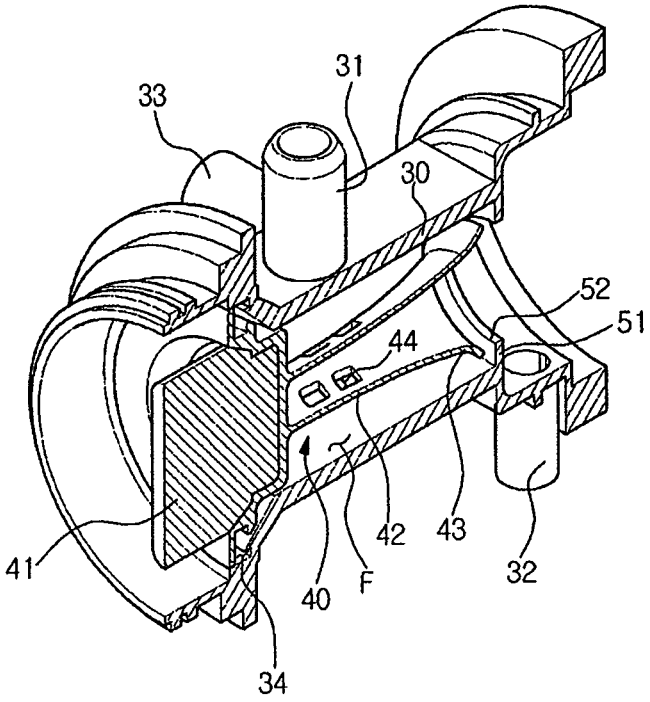
FIG. 3 is a partially broken-away perspective view of the drain device in accordance with the first embodiment.
Figure 4:
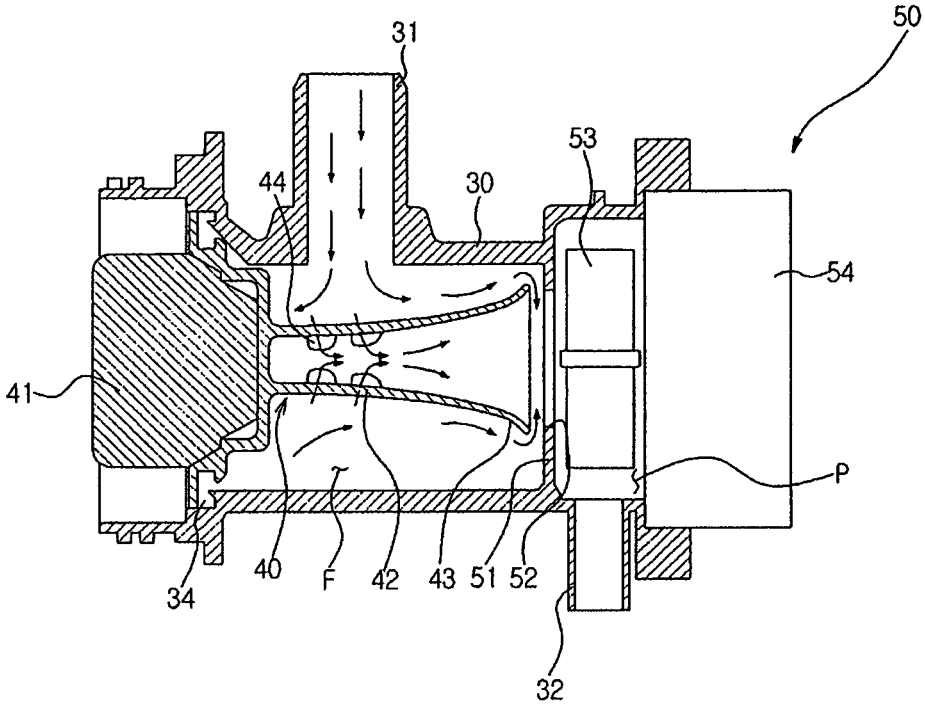
FIG. 4 is a sectional view of the drain device in accordance with the first embodiment.

FIG. 1 is a schematic perspective view of a drum washing machine in accordance with a first embodiment, FIG. 2 is an exploded perspective view of a drain device of the drum washing machine, FIG. 3 is a partially broken-away perspective view of the drain device, and FIG. 4 is a sectional view of the drain device.

With reference to FIGS. 1 to 4, a drum washing machine in accordance with a first embodiment includes a housing 10 forming an external appearance of the washing machine, a door 12 to open and close a laundry inlet 11 formed through a front surface of the housing 10, a tub 14 installed in the housing 10 and provided with a washing chamber 13 to accommodate laundry, a drum 15 rotatably installed in the tub 14, a water supply device 16 to supply washing water to the washing chamber 13, and a drain device 20 to drain the washing water of the washing chamber 13.

A detergent supply device 17 connected to the water supply device 16 supplying a detergent and a fabric rinse and a control panel 18 for manipulation by a user are installed on the front surface of the housing 10.

The drain device 20 includes an internal drain hose 21 connected to the tub 14, an external drain hose 22 to guide washing water flown to the drain device 20 to the outside of the housing 10, a drain case 30 provided with a filter chamber (F) and a pump chamber (P) formed therein, as shown in FIG. 3, a filter member 40 installed in the filter chamber (F), and a drain pump 50 installed in the pump chamber (P).

The internal drain hose 21 serves to discharge the washing water from the washing chamber 13 formed in the tub 14 to the outside of the washing chamber 13, and is provided with one end connected to a drain valve 23 installed at one side of a lower part of the tub 14 and the other end connected to an inlet pipe 31 installed at one side of the drain case 30. The drain valve 23 is installed in a through-hole (not shown) provided at one side of the lower part of the tub 14, and controls the drainage of the washing water.

The external drain hose 22 is provided with one end connected to an outlet pipe 32 installed at the other side of the drain case 30, and is extended to the outside of the housing 10. When the drain pump 50 is operated, the washing water flown into the drain case 30 is discharged from the pump chamber (P) through the outlet pipe 32, and is discharged to the outside of the housing 10 along the external drain hose 22.

The drain case 30 is exposed to the outside through a mounting hole (not shown) provided through a lower region of the front surface of the housing 10 so that the filter member 40 can be easily attached to and detached from the drain case 30. For example, the drain case 30 includes the inlet pipe 31 connected to the internal drain hose 21, the outlet pipe 32 connected to the external drain hose 22, an intermediate connection pipe 33 connected to an intermediate connection hose 24, and a drain filter pipe 34 serving as an opening part, through which the filter member 40 is detachably installed in the drain case 30. The intermediate connection hose 24 is provided with one end connected to a diaphragm 19 installed along a circumference of the laundry inlet 11, and serves to discharge air entered into the drain case 30 together with the washing water through the inlet pipe 31 to the outside of the drain case 30.

The washing water, flown into the drain case 30 through the inlet pipe 31, passes through the filter chamber (F) and the pump chamber (P) and is discharged to the outside of the drain case 30 through the outlet pipe 32, by the operation of the drain pump 50. The air, entered into the drain case 30 together with the washing water, is discharged to the outside of the drain case 30 through the intermediate connection pipe 33. Washing water, overflowing the laundry inlet 11 during a washing operation, flows along the inner circumferential surface of the diaphragm 19, and flows into the intermediate connection hole 24 through a through-hole (not shown) provided at one side of the inner circumferential surface of the diaphragm 19, and flows into the drain case 30 along the intermediate connection pipe 33.

The drain filter pipe 34 allows the filter member 40 to be attachably installed in the filter chamber (F) of the drain case 30, as shown in FIGS. 2 and 3, and thus the filter member 40 filters out foreign substances, such as hairs and nap, contained in the washing water flowing into the drain case 30 through the inlet pipe 31. The filter member 40 is provided integrally with a drain filter pipe lid 41 so that the filter member 40 can be easily replaced with a new lid.

The filter member 40 is extended from the lid 41 and has a sectional area that is gradually increased toward a pump chamber inlet 52 formed through a diaphragm 51 of the pump chamber (P) connected to the filter member (F), as shown in FIGS. 2 to 4. Unless the filter member 40 closes the pump chamber inlet 52, foreign substances will flow directly into the pump chamber (P), and damage an impeller 53, as stated in the above-described conventional drain device. The size of the pump chamber inlet 52 is varied according to the capacity of the drain pump 50. However, the pump chamber inlet 52 has a size enough to always maintain a designated amount of flowing water. Therefore, when the pump chamber inlet 52 is closed with a filter member 40 having a cylindrical shape, the sectional area of which is equal to that of the pump chamber inlet 52, the capacity of the filter chamber (F) is reduced and thus is easily clogged with foreign substances, and foreign substances having a bar shape, such as toothpicks and hairpins, do not completely come into the filter chamber (F) and are caught between the inlet pipe 31 and the filter chamber (F). Accordingly, the filter member 40 has a sectional area which is gradually increased, and has a conical shape, such as a trumpet, the outer surface of which has a symmetrical configuration and does not have any protrusion so that foreign substances are stably deposited on the filter member 40 due to the flow of the washing water.

More specifically, the filter member 40 includes a main body 42, which may be made of a synthetic resin, such as plastic, for example, and has a designated diameter, and an extension portion 43, which has a larger diameter than that of the main body 42. The main body 42 is provided with the lid 41, and the extension portion 43 is located adjacent to the pump chamber (P). An end terminal of the extension portion 43 is separated from the diaphragm 51 of the pump chamber (P) provided with the pump chamber inlet 52 at a minimal distance. A product of a separation distance from the end terminal of the filter member 40 to the pump chamber inlet 52 and the outer circumference of the end terminal of the filter member 40 is equal to or larger than the area of the outlet pipe 32 of the drain case 30. That is, the inflow of the washing water in the drain pump 50 should be at least equal to the outflow of the washing water in the drain pump 50. In the case that the inflow of the washing water in the drain pump 50 is smaller than the outflow of the washing water in the drain pump 50, air bubbles are generated and the speed of moving water current is increased, thus preventing foreign substances from being efficiently filtered out by the drain pump 50. In the case that the separation distance is excessively long, foreign substances may come directly into the pump chamber (P).

Further, the end terminal of the extension portion 43 covers the pump chamber inlet 52. That is, in the case that the filter member 40 has a polyprism shape, the shortest distance of the end terminal of the extension portion 43 is longer than the longest distance of the pump chamber inlet 52, and in the case that the filter member 40 has a conical shape, the diameter of the end terminal of the extension portion 43 is larger than the diameter of the pump chamber inlet 52, thus allowing the filter member 40 to prevent foreign substances from coming directly into the pump chamber inlet 52. The end terminal of the extension portion 43 may be flexible.

The main body 42 and the extension portion 43 are hollow, and at least one through-hole 44 is formed through the circumferential surface of the main body 42. The through-hole 44 easily passes the washing water toward the pump chamber (P) even when the gap between the extension portion 43 and the diaphragm 51 is clogged by foreign substances.

Further, the extension portion 43 has a thickness which is decreased toward the end terminal. In the case that a large amount of foreign substances are deposited on the extension portion 43, when the filter member 40 is cleaned, the filter member 40 is not easily separated from the drain filter pipe 34. Accordingly, when the thickness of the extension portion 43 is smaller than that of the main body 42, although a large amount of foreign substances are deposited on the extension portion 43, the diameter of the extension portion 43 is flexibly changed and thus the filter member 40 can be easily separated from the drain filter pipe 34.

The drain pump 50 serves to forcibly discharge washing water flown into the drain case 30 to the outside of the housing 10, and includes the impeller 53 installed in the pump chamber (P) of the drain case 30 and a pump motor 54 to rotate the impeller 53.

Other parts of the washing machine of the present embodiment are substantially the same as those of conventional washing machines, and detailed description and function thereof will be thus omitted because they are considered to be unnecessary.

Hereinafter, the installation and function of the above drain device 20 in accordance with the first embodiment will be described.

As shown in FIG. 1, the inlet pipe 31, the outlet pipe 32, and the intermediate connection pipe 33 of the drain case 30 are respectively connected to the internal drain hose 21, the external drain hose 22, and the intermediate connection hose 24 of the drain device 20, and the filter member 40 is formed integrally with the lid 41. Thus, the drain device 20 is detachably installed in the housing 10 from the outside through the mounting hole provided through the front surface of the housing 10.

The above drain device 20, which is installed in the housing 10, will be operated, as follows.

First, when a draining operation is started after a washing or rinsing operation is completed, the drain valve 23 is opened, and the drain pump 50 is operated. Then, the washing water in the washing chamber 13 is transferred to the drain case 30 through the internal drain hose 21, and the washing water transferred through the internal drain hose 21 is supplied to the filter chamber (F) of the drain case 30 through the inlet pipe 31. The washing water supplied to the filter chamber (F) passes through the gap between the extension portion 43 of the filter member 40 and the diaphragm 51 of the pump chamber (P) and is transferred to the pump chamber (P) through the pump chamber inlet 52. Foreign substances, which do not pass through the gap, are collected in the filter chamber (F). The filtered washing water is supplied to the pump chamber (P). Thereafter, the filtered washing water in the pump chamber (P) is discharged to the outside of the drain case 30 through the outlet pipe 32 by the operation of the drain pump 50, and is then discharged to the outside of the housing 10 through the external drain hose 22.

The foreign substances, collected in the filter chamber (F), are removed by separating the lid 41, formed integrally with the filter member 40, from the housing 10 and cleaning the inside of the drain case 30.

Figure 5:
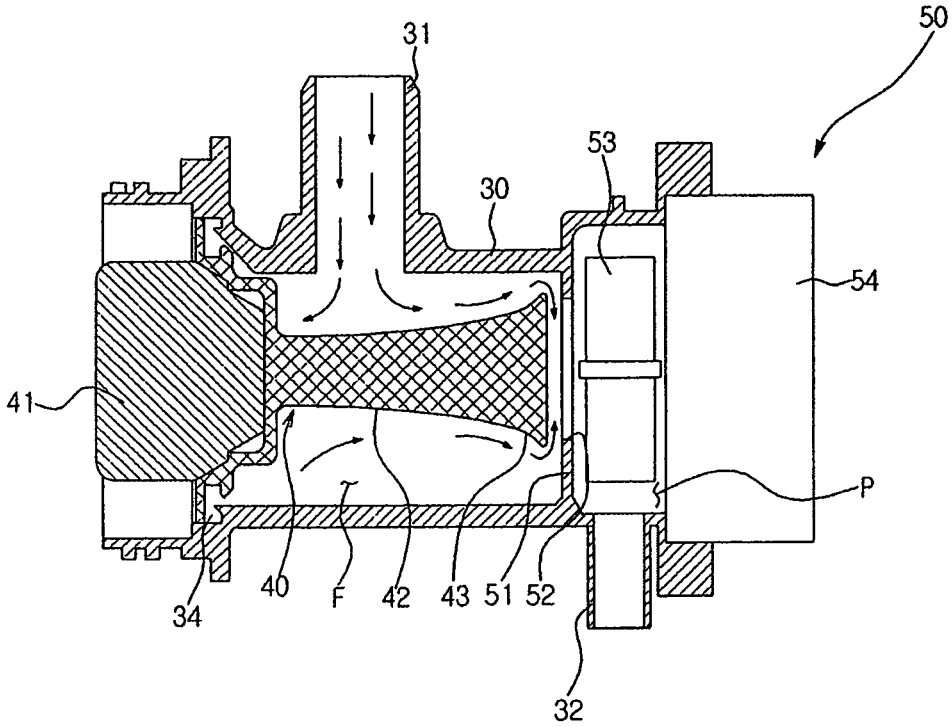
FIG. 5 is a sectional view of a drain device having a filter member in accordance with a second embodiment.

FIG. 5 is a sectional view of a drain device having a filter member in accordance with a second embodiment. This embodiment differs from the earlier embodiment in that the filter member 40 of this embodiment has a conical shape, the sectional area of which is gradually increased toward the pump chamber (P), but is not hollow. Further, the end terminal of the extension portion 43 of the filter member 40 is separated from the pump chamber inlet 52 at a designated distance. Accordingly, washing water is transferred to the pump chamber (P) through the gap between the end terminal of the extension portion 43 and the pump chamber inlet 52, and foreign substances contained in the washing water are caught in the gap and remain in the filter chamber (F).

Figure 6:
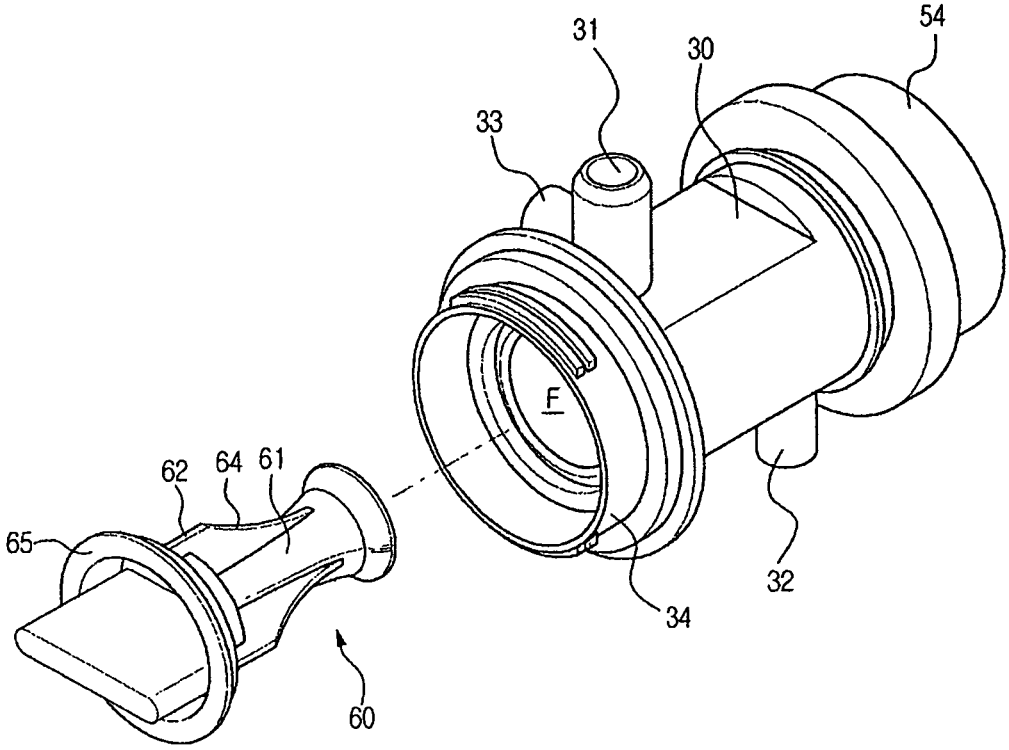
FIG. 6 is an exploded perspective view of a drain device having a filter member in accordance with another embodiment.
Figure 7:
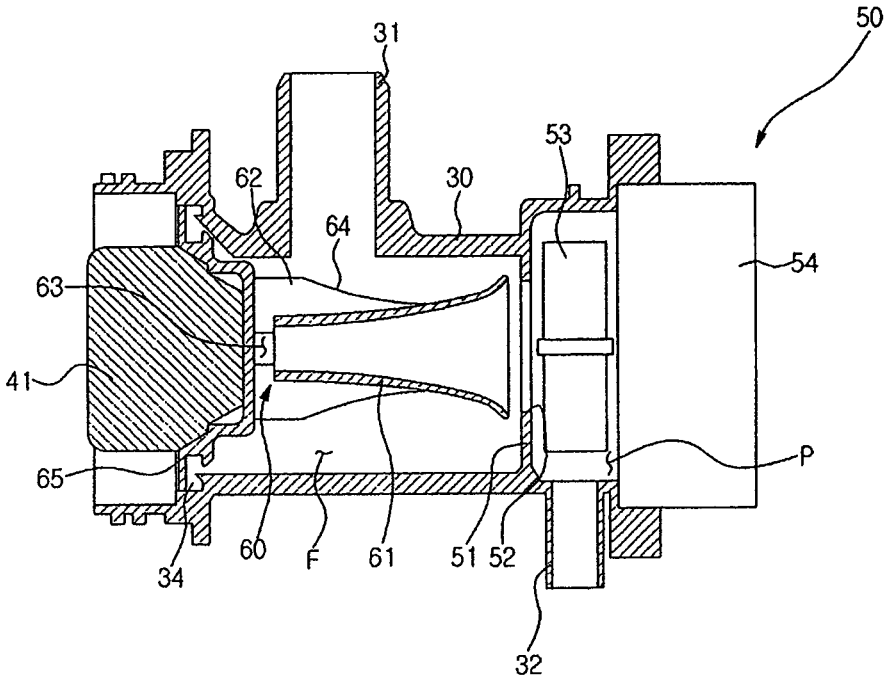
FIG. 7 is a partial broken-away sectional view of the drain device in accordance with another embodiment.

FIG. 6 is an exploded perspective view of a drain device of a washing machine in accordance with a third embodiment, and FIG. 7 is a partial broken-away sectional view of the drain device. Hereinafter, some parts in this embodiment are substantially the same as those in the earlier embodiment and thus denoted by the same reference numerals even though they are depicted in different drawings. Further, a part of the construction and operation of this embodiment are substantially the same as those of the earlier embodiment and a detailed description thereof will thus be omitted because it is considered to be unnecessary.

A filter member 60 of the drain device in accordance with this embodiment includes a core part 61 having a conical shape, such as a trumpet, and wing parts 62 disposed at regular intervals along a circumferential direction of the core part 61. In the same manner as the above-described earlier embodiment, the core part 61 includes a main body and an extension portion, and the end terminal of the extension portion is separated from a diaphragm 51 of a pump chamber (P) by a designated interval.

In accordance with this embodiment, a through hole 63 formed through the core part 61 is provided at a start terminal of a drain case 30 away from an inlet pipe 31 installed at the central portion of the drain case 30. In the case that the through hole 63 is provided at the central portion of the drain case 30 corresponding to the inlet pipe 31, washing water flowing into the drain case 30 is concentrated on the through hole 63 and the flow of the washing water is delayed, and thus the flow of the washing water becomes poor. Accordingly, in the case that the through hole 63 is provided at the start terminal of the drain case 30, i.e., the end of the drain case 30 close to a lid 41, the washing water that flows into the drain case 30 and is transferred to both end terminals of the filter member 60 by the core part 61 is properly distributed through the through hole 63 and a gap between the end terminal of the filter member 60 and the diaphragm 51 to go into the pump chamber (P). The through hole 63 may have a diameter of approximately 3 mm, for example, and is obtained by cutting the core part 61 in a circumferential direction.

The wing parts 62 are formed in a longitudinal direction of the core part 61 of the filter member 60. Here, a plurality of the wing parts 62 is disposed at regular intervals. The wing parts 62 form eddies of washing water, the transfer direction of which is changed from the center to the ends of the filter member 60 by the core part 61. Foreign substances contained in the washing water are gathered into one spot due to the eddies. Particularly, the plurality of the wing parts 62 forms local eddies between the wing parts 62, and the foreign substances are transferred to the ends of the filter member 60 due to the local eddies and are gathered.

More specifically, the wing parts 62, as shown in FIGS. 6 and 7, are extended so as to be upwardly sloped toward an opening part of the drain filter pipe 34 of the filter chamber (F) (i.e., in the direction of decreasing the sectional area of the core part 61). Sloped planes 64 of the wing parts 62 have a concave streamline shape. The sloped planes 64 having a concave streamline shape facilitate the formation of eddies of the washing water other than those formed by sloped planes having a rectilinear or convex shape, and preferably have an angle of 18~23°, for example, against the core part 61. In the case that the sloped planes 64 have an angle deviated from the above range, eddies cannot be properly formed or a force to transfer the washing water containing foreign substances is weak even though the eddies are formed. Although this embodiment describes four wing parts 62 installed at 90° intervals in the circumferential direction of the core part 61, the present invention is not limited thereto.

Hereinafter, with reference to FIG. 8, the operation of the above drain device in accordance with this embodiment will be described.

Washing water flowing into the filter chamber (F) through the inlet pipe 31 of the drain case 30 is dispersed into the upper and lower parts by the core part 61, and the dispersed washing water forms eddies through the wing parts 62.

Figure 8:
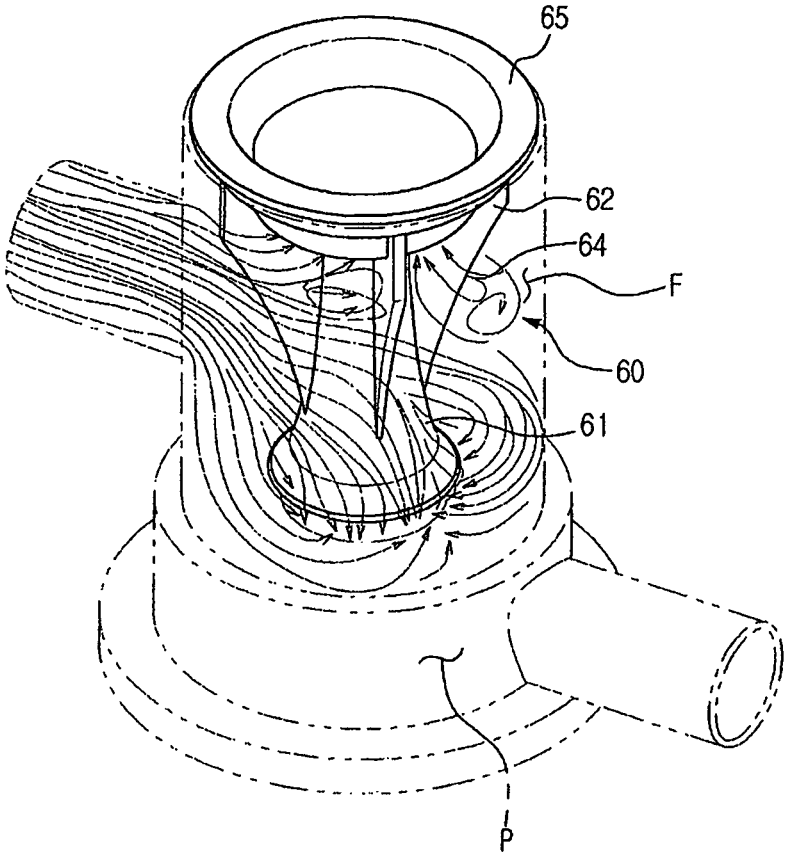
FIG. 8 is a schematic view illustrating the flow of washing water in the drain device in accordance with another embodiment.

The washing water, flowing to the upper part in the FIG. 8, is ascended by the eddies, passes through the through hole 63 at the end of the filter member 60 and the inside of the core part 61, and then flows into the pump chamber (P). Here, foreign substances having a small particle size contained in the washing water, i.e., a particle size smaller than the diameter of the through hole 63, together with the washing water are discharged to the outside through the through hole 63, and foreign substances having a relatively large particle size are lumped together at a corner of a base 65 of the filter member 60 by the eddies. Since the foreign substances lumped together at the corner does not obstruct the flow of the washing water even when the filter member 60 is used for a long time, the cleaning period of the filter member 60 is extended, compared with a conventional filter member.

The washing water, flowing to the lower part in the FIG. 8, is descended by the eddies, is transferred to the pump chamber (P) through the gap between the filter member 60 and the pump chamber (P). Here, foreign substances, which are not transferred through the gap, are collected in the filter chamber (F). Since these foreign substances having a large particle size do not obstruct the flow of the washing water, the cleaning period of the filter member 60 is extended, compared with the conventional filter member.

The foreign substances collected in the filter chamber (F) are removed by cleaning the inside of the drain case 30 by separating the lid 41, installed at the opening part 34 of the filter member 40, from the housing 10.

Although the above embodiments illustrate a drum washing machine, those skilled in the art will appreciated that the present embodiments may be applied to a pulsator washing machine or an agitator washing machine through proper modifications, additions, and substitutions.

As apparent from the above description, the present embodiments provide a drain device and a washing machine having the same, in which a filter member in a filter chamber has a sectional area, which is gradually increased toward an inlet of a pump chamber. Thus, even when foreign substances having a bar shape, such as toothpicks and hairpins, enter the drain device, the foreign substances do not get caught between an inlet pipe and a filter chamber of a drain case and stably come into the filter chamber. Further, since an extension portion of the filter member has a size larger than that of the inlet of the pump chamber, foreign substances cannot come directly into the pump chamber, and thus it is possible to effectively prevent damage to an impeller.

Moreover, although foreign substances are collected in the filter chamber of the drain device, the drain device induces the flow of washing water using a core part and wing parts and thus prevents the foreign substances from disturbing the flow of the washing water, thereby allowing the filter member to be used for a long time without frequently cleaning the filter member.

Although embodiments have been shown and described, it would be appreciated by those skilled in the art that changes may be made in these embodiments without departing from the principles and spirit of the invention, the scope of which is defined in the claims and their equivalents.

What is claimed is:

1. A drain device, comprising:

a drain case including a filter chamber provided with a filter member installed therein filtering out foreign substances from washing water; and a pump chamber connected to the filter chamber to forcibly discharge the washing water, wherein the filter member has a first section forming a main body and a second section forming an extension portion and the extension portion is provided with an end terminal separated from an inlet of the pump chamber by a designated distance, an inlet pipe is connected to one side of the drain case, the inlet pipe being disposed at a position facing the first section forming the main body of the filter member so that the inlet pipe does not face the second section forming the extension portion, the extension portion of the filter member extends by a designated distance toward the pump chamber from the main body in a direction perpendicular to an axial direction of the inlet pipe, has a thickness which is decreased toward the end terminal, and has a sectional area gradually increased toward the pump chamber, whereby the washing water, which inflows toward the main body of the filter member through the inlet pipe, flows along the extended and expanded extension portion of the filter member in the filter case and then drains, the filter member is hollow, and the main body is provided with at least one through hole.

2. The drain device according to claim 1, wherein the end terminal of the filter member covers the inlet of the pump chamber.

3. The drain device according to claim 2, wherein a shortest distance of an area of the end terminal of the filter member is longer than a longest distance of an area of the inlet of the pump chamber.

4. The drain device according to claim 1, wherein a product of a separation distance from the end terminal of the filter member to the inlet of the pump chamber and an outer circumference of the end terminal of the filter member is equal to or larger than an area of an outlet pipe of the drain case.

5. The drain device according to claim 1, wherein:

the filter member includes the main body and the extension portion having a sectional area larger than that of the main body.

6. The drain device according to claim 5, wherein the extension portion has a flexible end terminal.

7. The drain device according to claim 5, wherein:

the inlet pipe, through which the washing water flows into the filter chamber, is provided at a central portion of the filter chamber; and the through hole is provided at one end of the drain case.

8. The drain device according to claim 5, wherein the filter member further includes a plurality of wing parts formed in a longitudinal direction of the filter member.

9. The drain device according to claim 8, wherein the wing parts extend so as to be upwardly sloped in a direction of a decreased sectional area of the filter member, and sloped planes of the wing parts have a concave streamline shape.

10. The drain device according to claim 9, wherein the sloped planes have an angle of 18~23°.

11. A washing machine, comprising:

a housing provided with a washing chamber; and a drain device including a filter chamber provided with a filter member installed therein filtering out foreign substances from washing water in the washing chamber, and a pump chamber connected to the filter chamber to forcibly discharge the washing water, wherein the filter member has a first section forming a main body and a second section forming an extension portion and the extension portion is provided with an end terminal separated from an inlet of the pump chamber by a designated distance, an inlet pipe is connected to one side of the drain device, the inlet pipe being disposed at a position facing the first section forming the main body of the filter member so that the inlet pipe does not face the second section forming the extension portion, the extension portion of the filter member extends by a designated distance toward the pump chamber from the main body in a direction perpendicular to an axial direction of the inlet pipe, has a thickness which is decreased toward the end terminal, and has a sectional area gradually increased toward the pump chamber, whereby the washing water, which inflows toward the main body of the filter member through the inlet pipe, flows along the extended and expanded extension portion of the filter member in the filter case and then drains, the filter member is hollow, and the main body is provided with at least one through hole.

12. The washing machine according to claim 11, wherein:

the drain device further includes an opening part formed therethrough such that the filter member is attached to and detached from the drain device through the opening part; and the filter member is extended from a lid installed at the opening part.

13. The washing machine according to claim 11, wherein the end terminal of the filter member covers the inlet of the pump chamber.

14. The washing machine according to claim 13, wherein a shortest distance of an area of the end terminal of the filter is longer than a longest distance of an area of the inlet of the pump chamber.

15. The washing machine according to claim 11, wherein a product of a separation distance from the end terminal of the filter member to the inlet of the pump chamber and an outer circumference of the end terminal of the filter member is equal to or larger than an area of an outlet pipe of the drain device.

16. The washing machine according to claim 11, wherein:

the filter member includes the main body and the extension portion having a sectional area larger than that of the main body.

17. The washing machine according to claim 16, wherein the extension portion has a flexible end terminal.

18. The washing machine according to claim 16, wherein:

the inlet pipe, through which the washing water flows into the filter chamber, is provided at a central portion of the filter chamber; and the through hole is provided at the main body of the filter member.

19. The washing machine according to claim 16, wherein:

the filter member further includes a plurality of wing parts formed in a longitudinal direction of the filter member; and the wing parts extend so as to be upwardly sloped in a direction of a decreased sectional area of the filter member, and sloped planes of the wing parts have a concave streamline shape.

* * * * *

UNITED STATES PATENT AND TRADEMARK OFFICE

CERTIFICATE OF CORRECTION

PATENT NO. : 8,881,555 B2
APPLICATION NO. : 12/078940
DATED : November 11, 2014
INVENTOR(S) : Young Hyun Kim et al.

It is certified that error appears in the above-identified patent and that said Letters Patent is hereby corrected as shown below:

In the Specification

Column 1, Line 8:

Delete "May, 8," and insert --May 8,--, therefor.

Signed and Sealed this
Fifteenth Day of September, 2015

Michelle K. Lee

Michelle K. Lee
*Director of the United States Patent and Trademark Office*